US006106129A

United States Patent [19]

Cranor et al.

[11] Patent Number: 6,106,129

[45] Date of Patent: Aug. 22, 2000

[54] CHEMILUMINESCENT DEVICE HAVING PARTICLES WITH SECONDARY FLUORESCER FOR ENHANCE ILLUMINATION

[75] Inventors: Earl Cranor; Fred Kaplan, both of Longmeadow, Mass.

[73] Assignee: Omniglow Corporation, West Springfield, Mass.

[21] Appl. No.: 09/252,301

[22] Filed: Feb. 18, 1999

[51] Int. Cl.[7] ..... F21K 2/00

[52] U.S. Cl. ..... 362/34; 362/84; 362/104; 362/101; 362/318; 252/700; 250/462.1; 250/464.1; 250/504 R; 250/504 H

[58] Field of Search ..... 362/34, 84, 101, 362/318, 104, 166, 171, 178; 252/700; 250/462.1, 464.1, 503.1, 504 R, 504 H

[56] References Cited

U.S. PATENT DOCUMENTS

| | | | |
|---|---|---|---|
| 3,576,987 | 5/1971 | Voight | 240/2.25 |
| 4,061,910 | 12/1977 | Rosenfeld | 362/34 |
| 5,383,100 | 1/1995 | Kikos | 362/34 |

*Primary Examiner*—Sandra O'Shea
*Assistant Examiner*—Ismael Negron
*Attorney, Agent, or Firm*—McHale & Slavin

[57] ABSTRACT

A chemiluminescent illuminated novelty device employing a a light-filtering thermoformed vessel having a form for holding chemiluminescent reagents, e.g. a round shaped chemical holding section. The lighting effects generated by reaction of the chemiluminescent reagents are enhanced by the presence of particles containing a secondary fluorescer. In one embodiment, these particles may have a particular geometrical shape, e.g. a star or heart shape, and further contain a secondary fluorescer capable of being excited by the primary chemiluminescent light source so as to emit a secondary source of light which creates a glitter effect.

29 Claims, 1 Drawing Sheet

CHEMILUMINESCENT DEVICE HAVING PARTICLES WITH SECONDARY FLUORESCER FOR ENHANCE ILLUMINATION

FIELD OF THE INVENTION

This invention is directed to the field of chemiluminescent novelty lighting devices and, in particular, to chemiluminescent novelty devices that include glittering particles to enhance illumination.

BACKGROUND OF THE INVENTION

Chemiluminescent devices are non-incandescent products which produce light from a chemical mixture. The basic chemiluminescent process produces light when two chemical solutions are combined. The solutions may be combined and frozen to prevent activation or can be kept physically separated prior to activation. Physical separation typically consists of a sealed frangible glass vial containing a first solution that is placed within a second solution, both of which are housed in a sealed flexible vessel. When the vessel is flexed, the glass vial is ruptured thereby releasing the vial solution which admixes wherein the reaction produces light.

The chemical solutions are generally referred to as the "oxalate" component and the "activator" component. A typical oxalate component consists of Dibutyl Phthalate, CPPO and CBPEA. A typical activator solution contains Dimethyl Phthalate, T-butyl alcohol, 90% aq. Hydrogen Peroxide and Sodium Salicylate. As previously mentioned, the components may be frozen to retard the progress of the reaction. Alternatively, the components may be separated by a vial, pellet, separating wall, and so forth. Despite the type of separation, the object of these devices is to produce usable light. For this reason, the outer vessel is made of a light-filtering plastic material which permits the light produced by the reaction to pass through the vessel walls.

Numerous patents exist that disclose improvements in the oxalate and activators, such patents extending the illumination properties of chemiluminescent devices. The unique lighting effects generated from chemiluminescent lighting devices are enhanced by the inherent optical properties of the containing vessel. The color, clarity and degree of effervescence, if any, serve to add to dissipation of light throughout the vessel wall. Some dyes or coloring agents can be used not only as color filters but as fluorescers. A fluorescent dye functions by converting light of one wavelength to another wavelength. For example, blue light from a chemiluminescent device might be converted to red light by employing an appropriate fluorescer. This red light could be produced even if there was little or no red light emitted by the chemiluminescent device. When used with novelty items, most of these improvements strive to create attractive illumination about the area around the vessel and within the vessel itself. Various methods have been attempted to produce a glittering effect. Commercial glitter products have been included in the reagent formulation in the hope that they would produce the desired effect, however the chemiluminescent light did not reflect from these particles and they merely appeared as dark floating spots.

What is lacking in the art is a novelty chemiluminescent device containing materials which create enhanced illumination properties resulting in glittering particles which have contrasting or complimentary colors

SUMMARY OF THE INVENTION

The instant invention is a chemiluminescent lighting device consisting of a vessel containing an "oxalate" and an "activator" component. The vessel wall permits the distribution of light in a controlled manner so as to allow for illumination of the novelty device. For instance, vessels can be constructed from translucent polyethylene, polypropylene or the like material having light transmitting properties. The lighting effect generated by the chemiluminescent chemical reagents placed within the vessel is enhanced by the inclusion of numerous particles containing a secondary fluorescer. In one embodiment geometrically shaped particles may be used, including but not limited to shapes such as stars or hearts, and the particles may be formulated from any transparent or translucent resin, such as a polypropylene, a polyethylene, an ethylene-propylene copolymer or mixtures thereof, into which a secondary fluorescer has been extrusion compounded. These geometrically shaped particles may be placed within one of the reagent solutions, e.g. the oxalate solution prior to sealing. Upon combining the chemiluminescent chemicals, the light created by their reaction impinges upon the geometrically shaped particles, exciting the secondary fluorescer contained therein, and causing the particles to emit a contrasting or complimentary colored light.

Accordingly, it is an objective of the instant invention to disclose vessels containing a primary source of chemiluminescent light and supplementary particles which contain a secondary fluorescer for producing a contrasting or complimentary source of light.

It is a further objective of this invention to disclose a secondary fluorescing light source for use with chemiluminescent products having particular geometrical shapes.

Other objectives and advantages of this invention will become apparent from the following descriptions taken in conjunction with the accompanying drawings wherein set forth, by way of illustration and example, are certain embodiments of this invention. The drawings constitute a part of this specification and include exemplary embodiments of the present invention and illustrate various objects and features thereof.

DETAILED DISCLOSURE OF THE PREFERRED EMBODIMENTS

Figure 1:
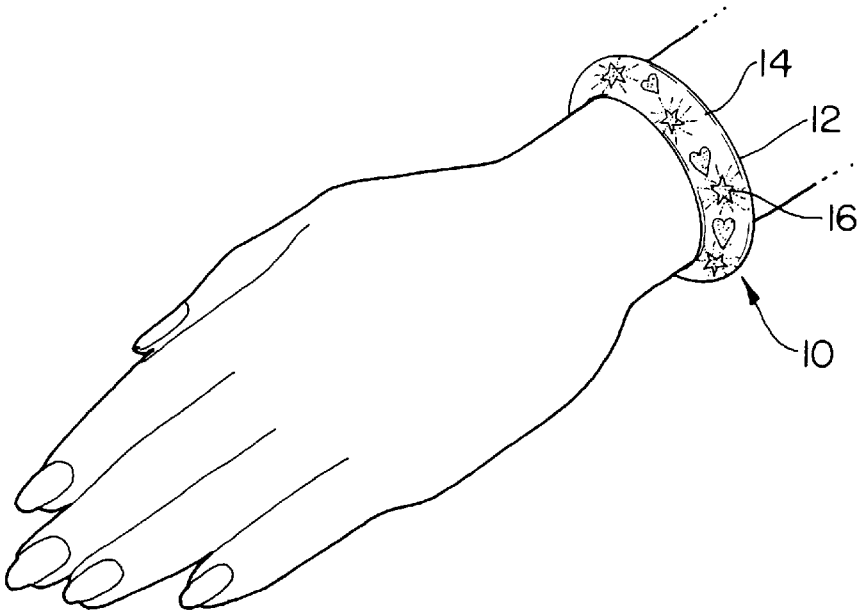
FIG. 1 is a pictorial view of the instant invention.

It is to be understood that while we have illustrated and described certain forms of the invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

Figure 2:
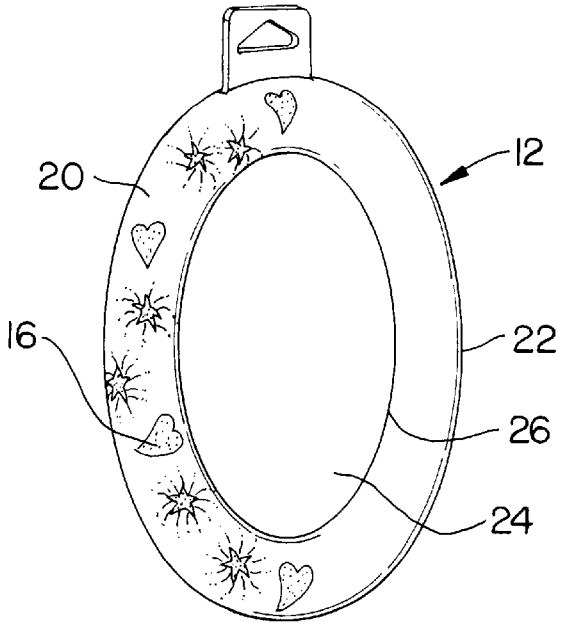
FIG. 2 is a cross-sectional view of the instant invention showing the distribution of particles containing the secondary fluorescer.

The improved chemiluminescent device of the instant invention, as depicted in FIG. 1 is a flexible, light-filtering thermoformed, injection molded or blow molded vessel 10 having an inner cavity 12 containing the chemical reagents 14 which produce the primary source of chemiluminescent light and particles 16 which contain the secondary fluorescer and which glitter by producing a secondary light source upon excitation by the primary light source. With reference to FIG. 2, a first reagent 20 is placed into the vessel 22, which may be round, e.g spherical or hemispherical; square, e.g. cubical or rectangular in cross-section, or formed in any convenient shape, including but not limited to cylindrical, conical and pyramidal. Into this reagent is placed a plurality of geometrically shaped particles 16 containing a secondary fluorescer additive. These particles are formed from a light transmitting material, e.g. a translucent or transparent thermoformed resin such as a polyolefin, into which a secondary fluorescer composition is compounded, for example during the extrusion or injection molding process. A second reagent 24, which is contained in a frangible ampoule 26, is also inserted into the chemical holding section of the container, and the container 22 is sealed. Manipulation of the flexible container so as to cause rupture of the frangible ampoule allows the two reagents to admix, whereby the reaction of the chemiluminescent reagents produce a chemically produced light. When light is transmitted throughout this lighting device, a portion of the light impinges upon the geometrically shaped particles contained therein, causing excitation of the secondary fluorescer and emission of a differently colored light. The use of contrasting or complimentary colors produce the most interesting effect, providing an enhanced illumination due to the production of secondary light sources which produce a unique and attractive glittering effect. Examples include, but are not limited to red plastic in white oxalate; red plastic in blue oxalate; orange plastic in green oxalate; or orange plastic in yellow oxalate. The glittering effect of the particles is perceived when they are positioned proximate the chemiluminescent light source.

Although the invention has been described in specific embodiments, it will be readily apparent to those skilled in this art that various modifications, rearrangements and substitutions can be made without departing from the spirit of the invention. The scope of the invention is defined by the claims appended hereto.

What is claimed is:

1. A chemiluminescent device comprising:

light-filtering thermoformed container having an inner cavity containing chemiluminescent reagents;

a plurality of particles containing a secondary fluorescer;

whereby activation of said chemiluminescent reagents produces a primary source of chemiluminescent light having a color which, when transmitted throughout said container, provides illumination by excitation of the secondary fluorescer and consequent emission of a differently colored light from said particles.

2. The chemiluminescent device according to claim 1 wherein said particles are formed from a light transmitting resin selected from the group consisting of polyethylenes, polypropylenes, ethylene-propylene copolymers and mixtures thereof.

3. The chemiluminescent device according to claim 1 wherein said particles are geometrically shaped.

4. The chemiluminescent device according to claim 1 wherein light produced by said chemiluminescent reagents and light emitted by said secondary fluorescer are selected so as to be of contrasting colors.

5. The chemiluminescent device according to claim 1 wherein light produced by said chemiluminescent reagents and light emitted by said secondary fluorescer are selected so as to be of complimentary colors.

6. The chemiluminescent device according to claim 1 wherein said primary source of light is white and said secondary fluorescer emits a red light.

7. The chemiluminescent device according to claim 1 wherein said primary source of light is blue and said secondary fluorescer emits a red light.

8. The chemiluminescent device according to claim 1 wherein said primary source of light is green and said secondary fluorescer emits an orange light.

9. The chemiluminescent device according to claim 1 wherein said primary source of light is yellow and said secondary fluorescer emits an orange light.

10. The device according to claim 1 wherein one of said reagents is in a sealed frangible ampoule.

11. An chemiluminescent device comprising:

a light-filtering container produced by a method selected from the group consisting of thermoforming, injection molding and blow molding having an inner cavity containing segregated chemiluminescent reagents in the form of an oxalate reagent and an activator reagent and characterized by the inclusion of a plurality of particles containing a secondary fluorescer;

whereby activation of said chemiluminescent reagents produces a chemiluminescent light having a color which, when transmitted throughout said container, provides enhanced illumination by excitation of the secondary fluorescer and consequent emission of a differently colored light from said particles.

12. The chemiluminescent device according to claim 11 wherein said particles are contained within the oxalate reagent.

13. The chemiluminescent device according to claim 11 wherein said particles are contained within the activator reagent.

14. The chemiluminescent device according to claim 11 wherein said particles are formed from a light transmitting resin selected from the group consisting of polyethylenes, polypropylenes, ethylene-propylene copolymers and mixtures thereof.

15. The chemiluminescent device according to claim 11 wherein said particles are geometrically shaped.

16. The chemiluminescent device according to claim 11 wherein light produced by said chemiluminescent reagents and light emitted by said secondary fluorescer are selected so as to be of contrasting colors.

17. The chemiluminescent device according to claim 11 wherein light produced by said chemiluminescent reagents and light emitted by said secondary fluorescer are selected so as to be of complimentary colors.

18. The chemiluminescent device according to claim 11 wherein said primary source of light is white and said secondary fluorescer emits a red light.

19. The chemiluminescent device according to claim 11 wherein said primary source of light is blue and said secondary fluorescer emits a red light.

20. The chemiluminescent device according to claim 11 wherein said primary source of light is green and said secondary fluorescer emits an orange light.

21. The chemiluminescent device according to claim 11 wherein said primary source of light is yellow and said secondary fluorescer emits an orange light.

22. The device according to claim 11 wherein one of said reagents is in a sealed frangible ampoule.

23. The chemiluminescent device according to claim 11 wherein said particles are contained within a combined mixture of said reagents.

24. The chemiluminescent device according to claim 23 wherein said combined mixture is frozen.

25. A chemiluminescent device comprising:

light-filtering thermoformed container having an inner cavity having a size and shape to support chemiluminescent reagents therein;

a plurality of particles having a particular geometrical appearance formed from a light transmitting resin and containing a secondary fluorescer therein;

whereby activation of said chemiluminescent reagents produces a primary source of chemiluminescent light having a color which, when transmitted throughout said container, provides illumination by excitation of the secondary fluorescer and consequent emission of a differently colored light from said particles.

26. The device according to claim 25 wherein said shape is selected from the group consisting of round, square, cylindrical, conical and pyramidal.

27. The device according to claim 25 wherein one of said reagents is in a sealed frangible ampoule.

28. The chemiluminescent device according to claim 25 wherein said inner cavity is sized to support a chemiluminescent oxalate reagent and an activator reagent in the form of separate and distinct reagents or as a combined mixture of said reagents, and wherein said secondary fluorescer containing particles are disposed within any one reagent selected from the oxalate reagent, the activator reagent or the combined mixture of said reagents.

29. The device according to claim 28 wherein said combined mixture of reagents is frozen.

* * * * *